US007302044B2

(12) United States Patent
Gabioud

(10) Patent No.: US 7,302,044 B2
(45) Date of Patent: Nov. 27, 2007

(54) X-RAY GENERATOR TUBE COMPRISING AN ORIENTABLE TARGET CARRIER SYSTEM

(75) Inventor: André Gabioud, Thonon les Bains (FR)

(73) Assignee: Thales, Neuilly-Sur-Seine (FR)

( * ) Notice: Subject to any disclaimer, the term of this patent is extended or adjusted under 35 U.S.C. 154(b) by 0 days.

(21) Appl. No.: 10/561,262

(22) PCT Filed: Jun. 17, 2004

(86) PCT No.: PCT/EP2004/051143

§ 371 (c)(1),
(2), (4) Date: Dec. 19, 2005

(87) PCT Pub. No.: WO2004/114353

PCT Pub. Date: Dec. 29, 2004

(65) Prior Publication Data

US 2007/0064873 A1 Mar. 22, 2007

(30) Foreign Application Priority Data

Jun. 20, 2003 (FR) ..... 03 07498

(51) Int. Cl.
*H01J 35/10* (2006.01)

(52) U.S. Cl. ..... 378/144; 378/125

(58) Field of Classification Search ..... 378/124–126, 378/143, 130, 141, 127, 144, 119
See application file for complete search history.

(56) References Cited

U.S. PATENT DOCUMENTS

| | | | | |
|---|---|---|---|---|
| 1,714,975 | A * | 5/1929 | Coolidge | 378/140 |
| 4,988,910 | A | 1/1991 | Gabioud | |
| 5,535,255 | A * | 7/1996 | Gabbay | 378/200 |
| 5,892,809 | A * | 4/1999 | Wittry | 378/85 |
| 7,162,005 | B2 * | 1/2007 | Bjorkholm | 378/57 |
| 2004/0263050 | A1 | 12/2004 | Gabioud et al. | |

FOREIGN PATENT DOCUMENTS

| | | |
|---|---|---|
| DE | 619 561 C | 10/1935 |
| FR | 1 129 144 A | 1/1957 |
| FR | 2 208 298 A | 6/1974 |

* cited by examiner

*Primary Examiner*—Hoon Song
(74) *Attorney, Agent, or Firm*—Lowe Hauptman Ham & Berner, LLP

(57) ABSTRACT

The field of the invention is that of X-ray generator tubes. The invention relates more specifically to the arrangement of the emitting surfaces which are the source of the X-ray radiation. It is known that the inclination of the emitting surface known as the target to the electron beam governs the intensity of X-ray emission and the resolution of the tube. The target carrier assembly according to the invention allows this inclination to be set according to the desired application. For high-energy applications requiring a cooling circuit, the arrangement of the component also allows an appreciable improvement to the geometry of said cooling circuit so as to appreciably improve its efficiency. Several layouts of cooling circuit are presented, together with methods for producing them.

6 Claims, 8 Drawing Sheets

FRONT VIEW

SIDE VIEW

X-RAY GENERATOR TUBE COMPRISING AN ORIENTABLE TARGET CARRIER SYSTEM

BACKGROUND OF THE INVENTION

1. Field of the Invention

The field of the invention is that of X-ray generator tubes. The invention relates more specifically to the arrangement of the emitting surfaces which are the source of the X-ray radiation.

2. Description of the Prior Art

The principle of operation of an X-ray generator tube 10 is set out in FIG. 1. It mainly comprises a vacuum chamber 6 comprising, at one of its ends, a cathode unit 4 borne by an insulator 3 and, at the other end, an anode unit 2. The anode unit 2 comprises a target carrier assembly 1 comprising a flat metal surface known as the target 9 positioned facing the cathode unit. The electron beam 7 originating from the cathode is accelerated under the action of very high electrical voltages in excess of 10 kVolts and strikes the target 9 in a focusing region O where the electrons lose their kinetic energy. This results in a significant release of heat and in an emission 8 of X-ray radiation (symbolized by the arrows in FIG. 1). The X-ray radiation passes through the wall of the anode unit at favored locations 5 known as windows.

The release of heat causes very intense localized heating at the target. In the case of tubes operating at high power, the rise in temperature of the target is such that it could cause the target to become destroyed by melting. Hence, in such cases, the release of heat is removed by a cooling circuit 60 passing through the target carrier 1 under the target 9.

In order to optimize the distribution of the X-ray radiation in space in terms of direction and in terms of intensity, the target 9 is inclined by an angle $\alpha$ with respect to the mean direction of the electron beam 7.

The production of a target carrier assembly therefore is subject to two main constraints: on the one hand, the angle of inclination $\alpha$ needs to be suited to the use and, on the other hand, the cooling circuit needs to allow sufficient removal of heat energy due to the impact of the electron beam.

In known X-ray radiation tubes, the target carrier assembly generally has the shape of a stepped cylinder as depicted in FIGS. 2, 3 and 4. The axis of this cylinder is parallel to the direction of the electron beam. A truncated face of the cylinder inclined by an angle $\alpha$ constitutes the target subjected to the action of the beam.

When the power is low, a cooling circuit is not needed. In this case, which is illustrated in FIG. 2, the target carrier assembly is connected to the anode unit so that the heat energy is transmitted first of all to the periphery of the anode unit by conduction through the various metal parts of the target carrier assembly and of the anode unit (internal white arrows in FIG. 2) then removed to the outside by convection (external white arrows in FIG. 2).

When the emitted power is higher, the above arrangement will no longer suffice. In such cases, a circulation duct for cooling fluid which may, for example, be water or oil, is needed in order to remove the heat energy from the target. This fluid is let in and out in the part of the target carrier assembly at the opposite end from the target. FIG. 3 illustrates a first embodiment of the cooling duct positioned inside the target carrier assembly. It comprises a single tube 60 passing under the surface of the target and which follows the lines of said surface as best it can. FIG. 4 illustrates a second embodiment of this duct, of a coaxial type. It comprises an inlet tube 60 lying along the axis of the cylinder of the target carrier, an internal cavity 61 following the lines of the interior of the target carrier as best it can, and an outlet tube 62 connected to the internal cavity. This arrangement is able to optimize the area for heat exchange between the cooling fluid and the target carrier assembly.

However, these various types of cooling circuit have disadvantages. In particular, these ducts have elbows which lead to changes in direction for the fluid. These changes in direction generate, at the surfaces for heat exchange with the target carrier assembly, regions in which the velocity of the fluid is practically zero and in which the heat exchanges are therefore very low. In addition, these changes in direction induce pressure drops which may prove prohibitive when the fluid flow rate needs to be increased in order to improve the heat dissipation capabilities.

When an electron beam strikes the surface of the target at an angle of incidence $\alpha$ corresponding to the angle of inclination of the target, the X-ray radiation is emitted in all directions in space as indicated in FIG. 5. The emission intensity profile is dependent on the angle $\theta$ made by the direction of the radiation with respect to the normal N to the surface of the target (the boundary depicted in dotted line in FIG. 5). This profile exhibits a maximum for zero $\theta$ and tends toward 0 as $\theta$ tends toward 90 degrees. Not all of the X-ray radiation emitted can be used, and only some is collected through a transmission window which defines a limited solid emission angle. This window is necessarily situated outside the path of the electron beam. If a significant proportion of the emitted radiation is to be recovered, the angle of inclination $\alpha$ has then to be sufficiently great.

However, the angle of inclination also governs the geometric resolution of the X-ray emission source as illustrated in FIGS. 6 and 7. An electron beam 7 of circular cross section with diameter Ø, a cross section also known as the fineness, impinges on a target inclined by an angle $\alpha$ with respect to the direction of incidence. This beam will generate X-ray radiation. In a given emission direction, the X-ray radiation, passing through a very small-diameter diaphragm 11, then has a divergence $\beta$. This divergence $\beta$ is proportional to the angle $\alpha$ as shown in FIGS. 6 and 7. This divergence $\beta$ governs the resolution of the X-ray generator tube and the sharpness of the perceived images. Indeed, if a screen 12 is placed in the path of the X-ray radiation, the image of the diaphragm is no longer practically an isolated spot but has a certain dimension directly proportional to the divergence $\beta$. In consequence, in order to obtain small-sized images, that is to say high resolutions, it is necessary to reduce the angle of inclination $\alpha$.

The angle of inclination $\alpha$ is, of necessity, the result of a compromise between, on the one hand, the energy of the X-ray radiation and, on the other hand, the resolution of the tube. Depending on the application, tube designers therefore have, for the same tube configuration, to provide different versions of target carrier assembly in which the angles of inclination of the target vary. Designing, producing and managing these different variants leads to additional costs and longer time scales which may be great, given the complexity of the part and the materials used.

SUMMARY OF THE INVENTION

The invention proposes to replace these different variants with a single assembly that allows the angle of inclination of the target to be set. The arrangement of the part also allows the geometry of the cooling circuit to be improved so as to substantially increase its efficiency. Furthermore, the various mechanical parts do not involve complex machining.

More specifically, the subject of the invention is an X-ray generator tube comprising an electron gun emitting an electron beam, an anode unit comprising a target carrier assembly having a flat surface known as the target onto which the electron beam is focused in a focusing spot (O), characterized in that the target carrier assembly has an axis of revolution substantially perpendicular to the mean direction of the electron beam and passing through the plane of the target.

Advantageously, the target carrier assembly is of cylindrical shape overall with a circular cross section, the target being situated in a plane passing through the axis of revolution of the cylinder and the anode unit comprises a housing, also of cylindrical shape overall and in which said target carrier assembly is housed such that the axis of revolution of the target carrier assembly passes through the focusing spot.

For applications requiring a great deal of X-ray radiation, advantageously the target carrier assembly comprises at least one main internal cooling-fluid-circulation duct passing through the target carrier assembly in a direction substantially parallel to its axis of revolution and passing under the target in order to cool it.

BRIEF DESCRIPTION OF THE DRAWINGS

The invention will be better understood and other advantages will become apparent from reading the description which will follow, given without implied limitation and with assistance from the attached figures among which.

MORE DETAILED DESCRIPTION

The heart of the invention is to make the angle of inclination of the target with respect to the mean direction of the electron beam settable while at the same time maintaining the focusing of the beam on the target. There are various possible mechanical arrangements.

Figure 1:
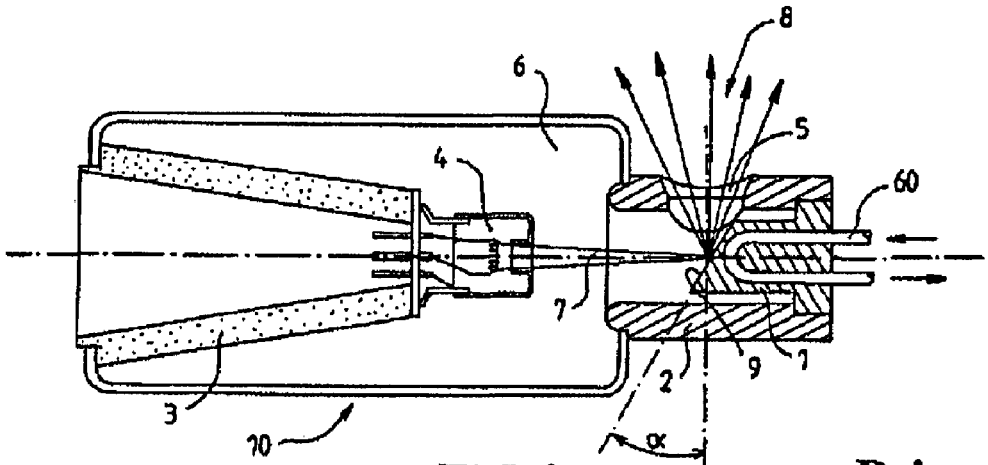
FIG.1 Prior Art
FIG. 1 depicts a view in cross section of an X-ray generator tube comprising a target carrier assembly according to the prior art.
Figure 2:
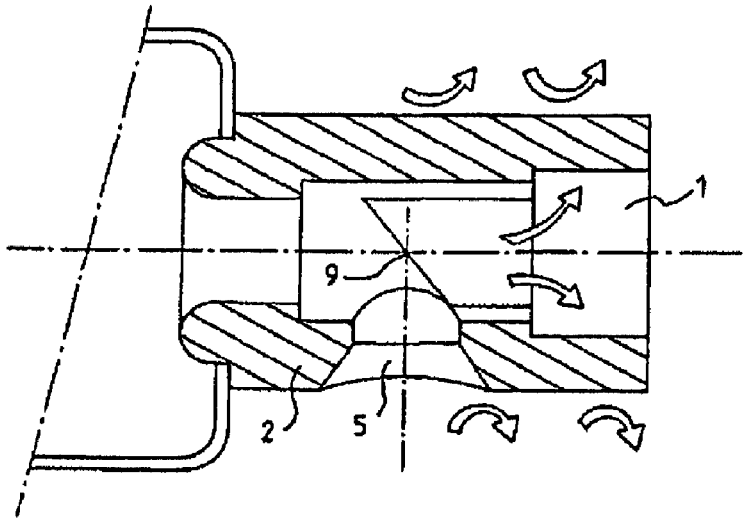
FIG.2 Prior Art
FIG. 2 depicts a view in cross section of an anode unit comprising a target carrier assembly without a cooling circuit, according to the prior art.
Figure 3:
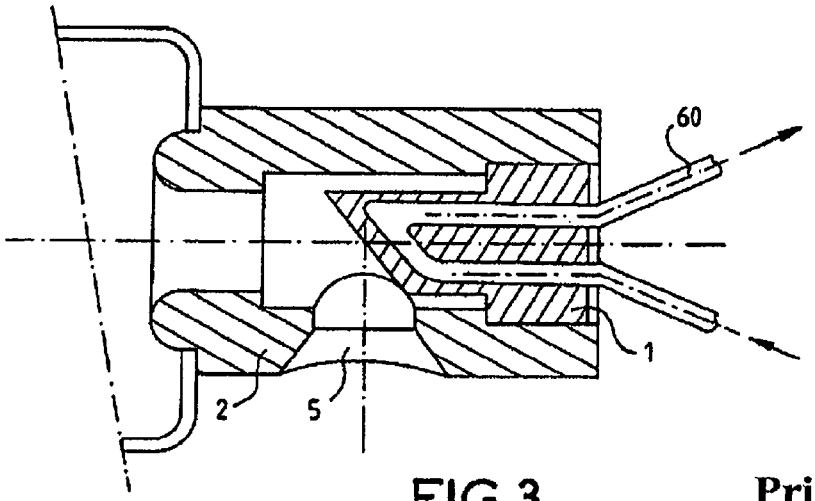
FIG.3 Prior Art
FIG. 3 depicts a view in cross section of an anode unit comprising a target carrier assembly comprising a first type of cooling circuit, according to the prior art.
Figure 4:
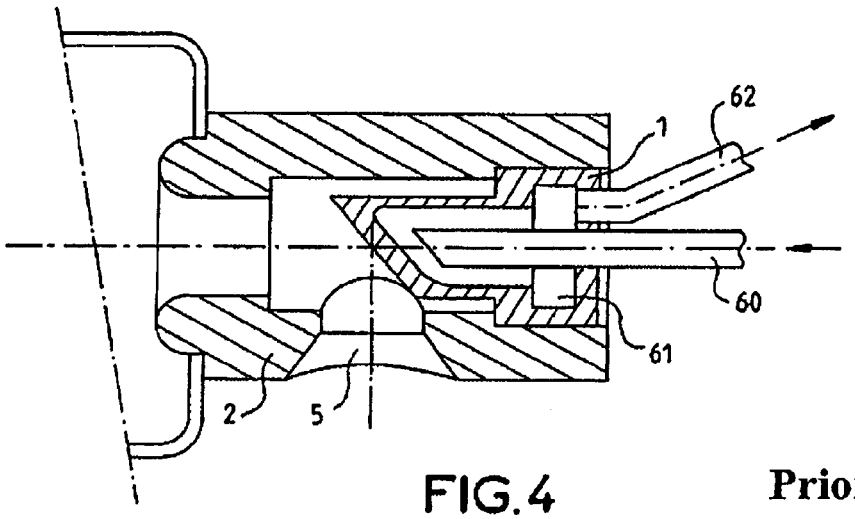
FIG.4 Prior Art
FIG. 4 depicts a view in cross section of an anode unit comprising a target carrier assembly comprising a second type of cooling circuit, according to the prior art.
Figure 5:
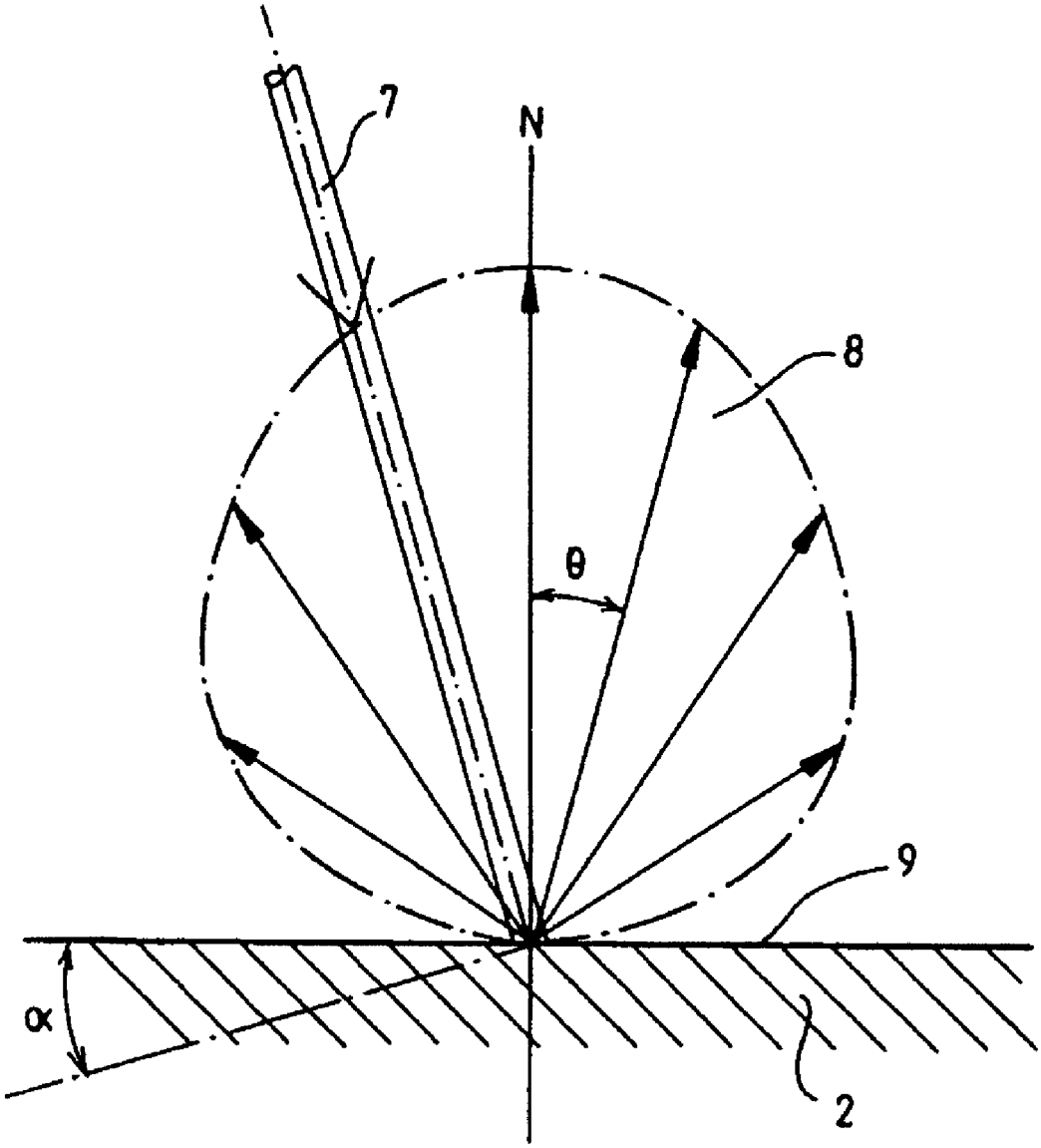
FIG. 5 depicts the X-ray radiation emission profile.
Figure 6:
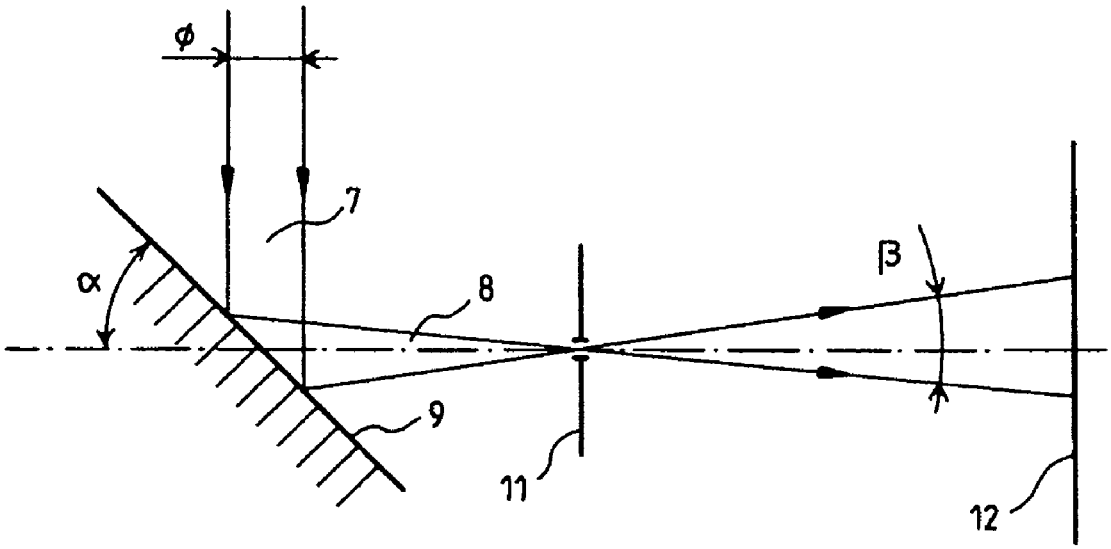
FIGS. 6 and 7 depict the influence of the angle of inclination of the target on the resolution of the tube.
Figure 7:
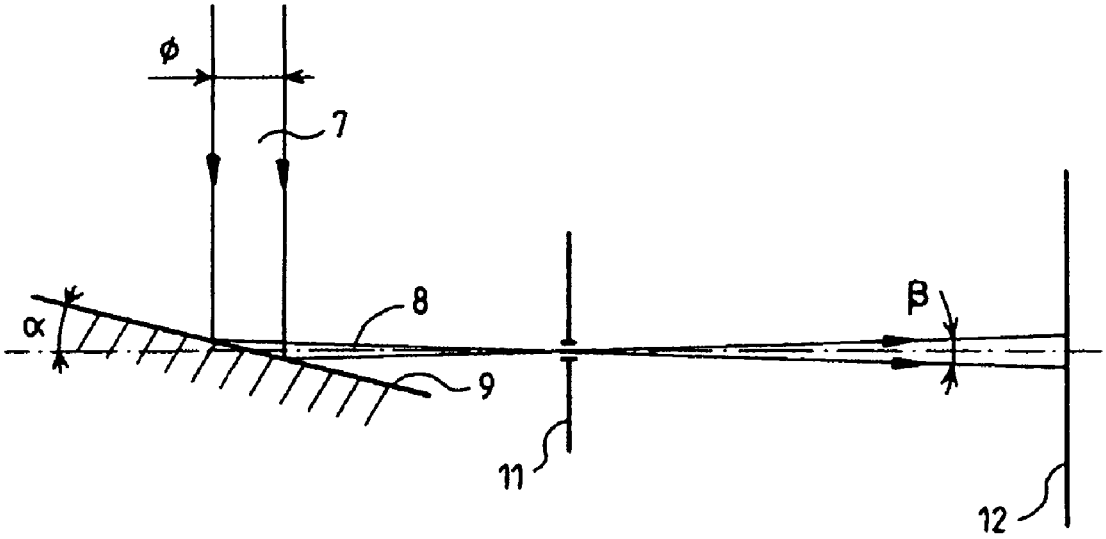
Figure 8:
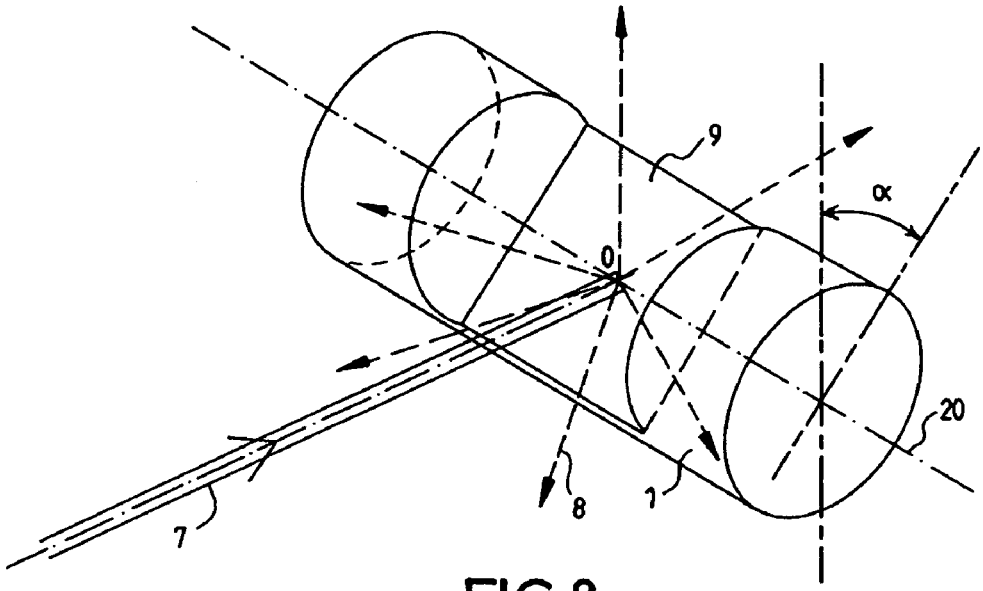
FIG. 8 depicts a perspective view of the target carrier assembly according to the invention.
Figure 9:
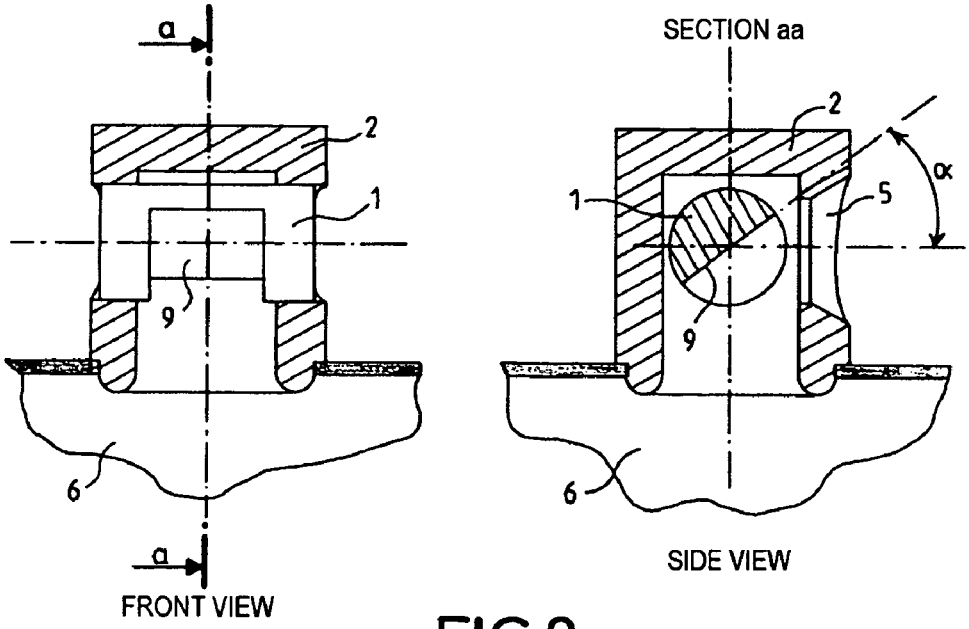
FIG. 9 depicts a front view and a side view of the target carrier assembly according to the invention.

By way of nonlimiting example, the target carrier assembly 1 has the overall form depicted in the perspective view of FIG. 8. This figure depicts a target carrier assembly 1 without a cooling-liquid circulation duct. The target carrier assembly overall has the shape of a cylinder of revolution. The central part of this cylinder has machining. In this machined part, half of the cylinder has been removed to define a flat surface 9 which constitutes the surface of the target. Thus, the target lies in a plane passing through the axis 20 of the cylinder such that when the cylinder is rotated about its axis, the center of the target always occupies a fixed position. FIG. 9 depicts a front view and a side view in cross section of the target carrier assembly 1 mounted in the anode unit 2. The latter comprises a cylindrical recess of a diameter substantially equal to that of the target carrier assembly such that said assembly 1 can rotate without play in the anode unit. The axis of revolution of this cylinder is substantially perpendicular to the mean direction of the electron beam and this axis passes through the focusing spot of the electron beam 7 as indicated in FIG. 8. This arrangement allows the diameter of the focusing spot O to be optimized. This being the case, when the target carrier assembly is rotated in the anode unit, the surface of the target becomes inclined by a variable angle $\alpha$ and the focusing of the electron beam on the target is maintained. In order to position the target at a particular angle $\alpha$, there are various possible methods that can be employed, for example using suitable tooling which does not form part of the subject of this invention and is known to those skilled in the art. Once this inclination has been set, the target carrier assembly is brazed into the anode unit in order on the one hand to maintain this inclination and, on the other hand, to make the assembly vacuum tight, which vacuum tightness is needed for the electron gun to work. This arrangement is highly advantageous in as much as the operations of machining the various parts (the target carrier assembly and the anode unit) are simple operations and can be performed with high precision.

Figure 10:
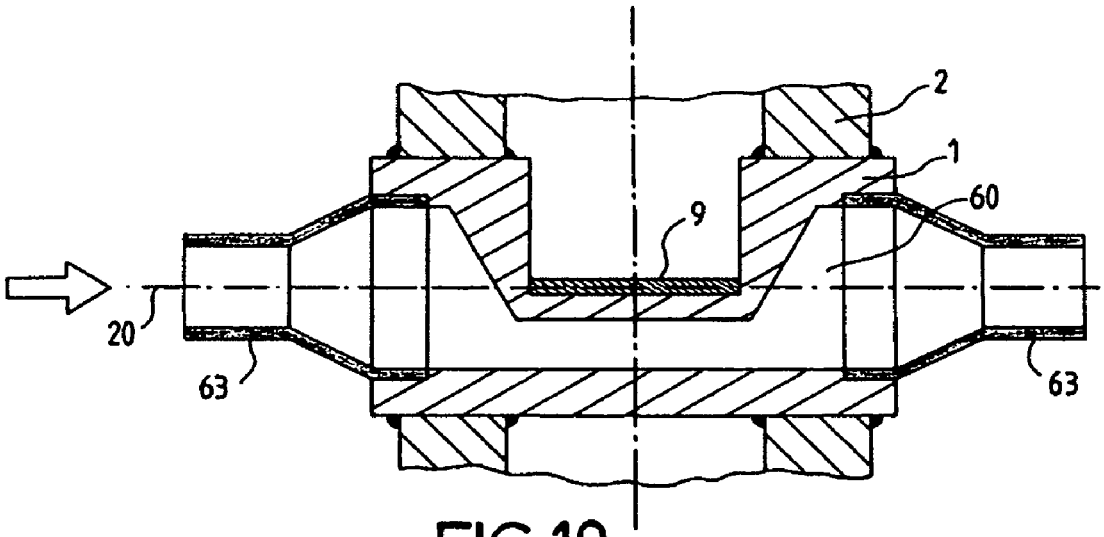
FIG. 10 depicts a view in cross section of a target carrier assembly according to the invention comprising a cooling-fluid-circulation duct.

In the case of high-powered tubes requiring a cooling-liquid-circulation duct, the above arrangement lends itself particularly well to the installation of said duct. By way of example, FIG. 10 depicts a view in cross section of a target carrier assembly of the type of those in FIGS. 8 and 9 comprising a cooling-fluid-circulation duct 60. This duct passes right through the target carrier assembly along its axis of revolution and passes under the target 9. The exchange of heat energy occurs mainly in the region situated under the target which is known as the exchanger. This geometry, which has no mechanical elbows, ensures good transfer of the cooling liquid through the target carrier assembly, this being better than that achieved with devices according to the prior art. Cuffs 63 positioned at the ends of the duct allow it to be connected to the cooling liquid inlet and discharge circuits.

The design of the exchanger governs the efficiency of the cooling-liquid-circulation duct. It is the result of a compromise between optimum efficiency and acceptable mechanical complexity.

Figure 11:
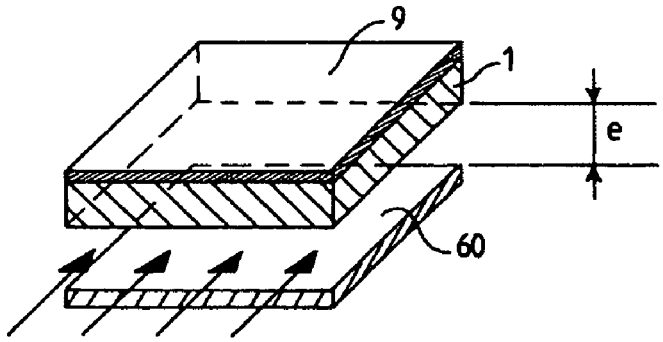
FIG. 11 depicts a perspective view of that part of the duct that lies under the target.

In a first type of embodiment presented in the perspective view of FIG. 11, the exchanger consists mainly of two mutually parallel flat walls separated by a thickness e. The first wall is situated under the target and parallel thereto. In consequence, the water flows through the exchanger in the form of a layer of thickness e (parallel arrows in FIG. 11). This exchanger has low performance given its limited surface area for heat exchange. It is possible to improve its efficiency by using it in a diphase mode, the amounts of heat absorbed by the changes in phase, for example when the liquid water changes into vapor form, thus improving the efficiency of the cooling circuit.

Figure 12:
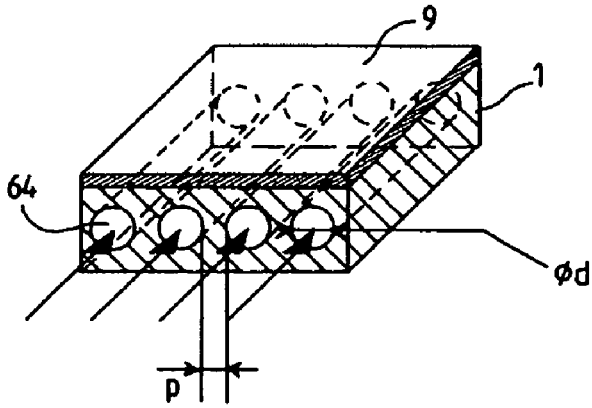
FIG. 12 depicts a perspective view of a collection of cylindrical secondary ducts of circular cross section placed under the target.
Figure 13:
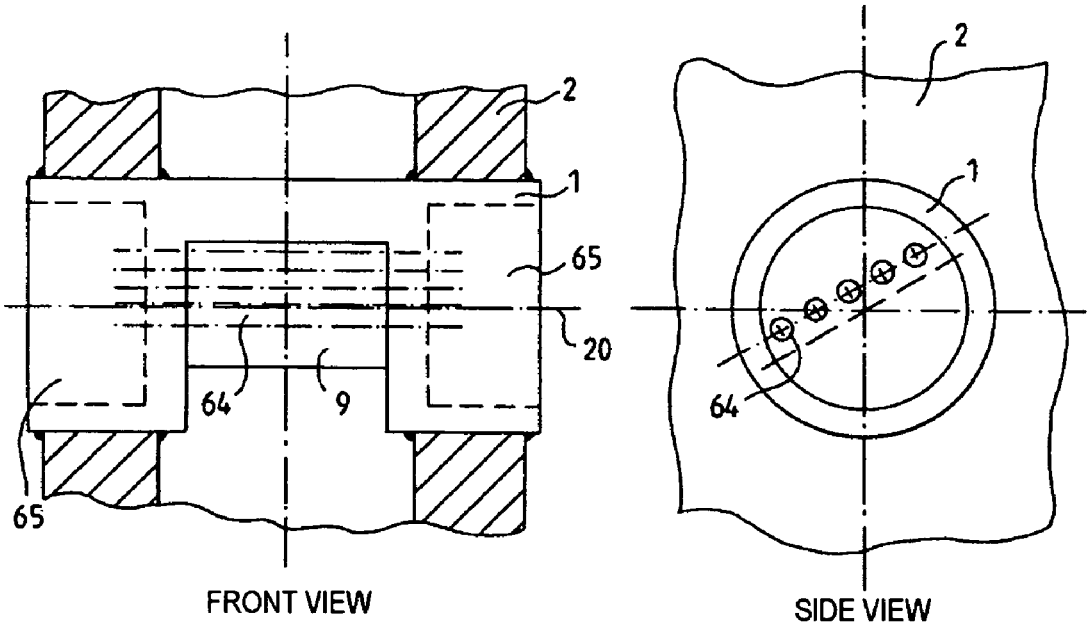
FIG. 13 depicts a front view in cross section and a side view of the target carrier assembly comprising cylindrical secondary ducts of circular cross section.

In order to improve the efficiency of the exchanger, it is also possible to increase the surface area of the heat exchange surface. The perspective view of FIG. 12 shows a first embodiment of an exchanger with a large heat exchange surface area. In this embodiment, the heat exchange surface consists of a plurality of secondary ducts 64 of cylindrical shape and with generatrices parallel to the axis of revolution of the target carrier assembly. The ducts 64 are separated by a wall of thickness P and have a diameter d. Typically, the diameter d ranges between 0.8 millimeters and 3 millimeters and the thickness P must be smaller than d. The heat exchange surface area is thus optimized and in this case is far higher than that illustrated in FIG. 11. FIG. 13 depicts two views of the target carrier assembly comprising a heat exchanger according to the above arrangement. In this case, the duct 60 at its ends comprises two cylindrical drillings 65 and, in the region of the exchanger, a plurality of secondary ducts 64 in the arrangement of FIG. 12, each of these ducts opening into the cylindrical drillings 65. When the target carrier assembly is oriented as shown in the side view, the entirety of the exchanger follows the inclination of the target. The machining of the duct can be done simply by drilling from one of the ends of the cylinder.

However, drilling holes of small diameter, typically smaller than 1.5 millimeters, in materials such as copper may prove to be difficult over long lengths, typically lengths greater than 10 times their diameter. In such cases, it is possible to replace the method for producing the exchanger by conventional machining with the method comprising the following steps:

producing a first mechanical assembly 1 of cylindrical shape overall comprising a main duct 65 passing through said first assembly in a direction substantially parallel to its axis of revolution and in its central part a recess comprising a flat surface 101, the main duct 65 opening into this recess;

producing a second mechanical assembly 102 comprising a flat top surface and a bottom surface comprising identical grooves 103, it being possible for this second assembly to be of cylindrical shape overall;

assembling the second assembly in the recess of the first assembly in such a way that the grooves 103 are placed facing the flat surface 101 of the recess, the top surface of the second assembly constituting the target 9, the collection of grooves of the second assembly and of the flat surface of the recess constituting so many secondary ducts that form the exchanger.

Figure 14:
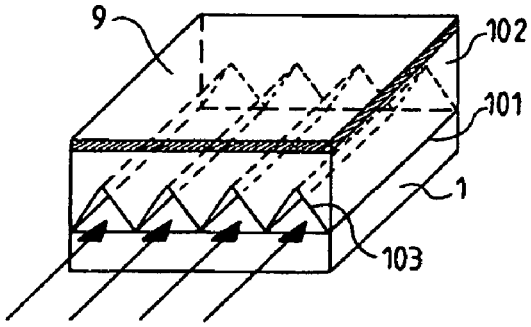
FIG. 14 depicts a perspective view of a collection of cylindrical secondary ducts of triangular cross section, placed under the target.
Figure 15:
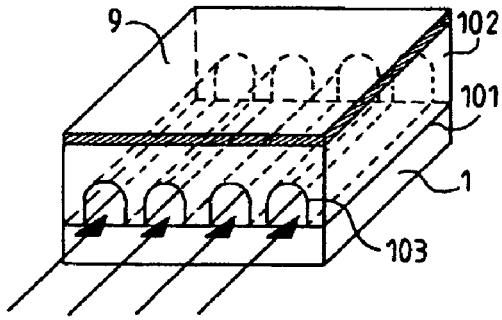
FIG. 15 depicts a perspective view of a collection of cylindrical secondary ducts of arch-shaped cross section placed under the target.
Figure 16:
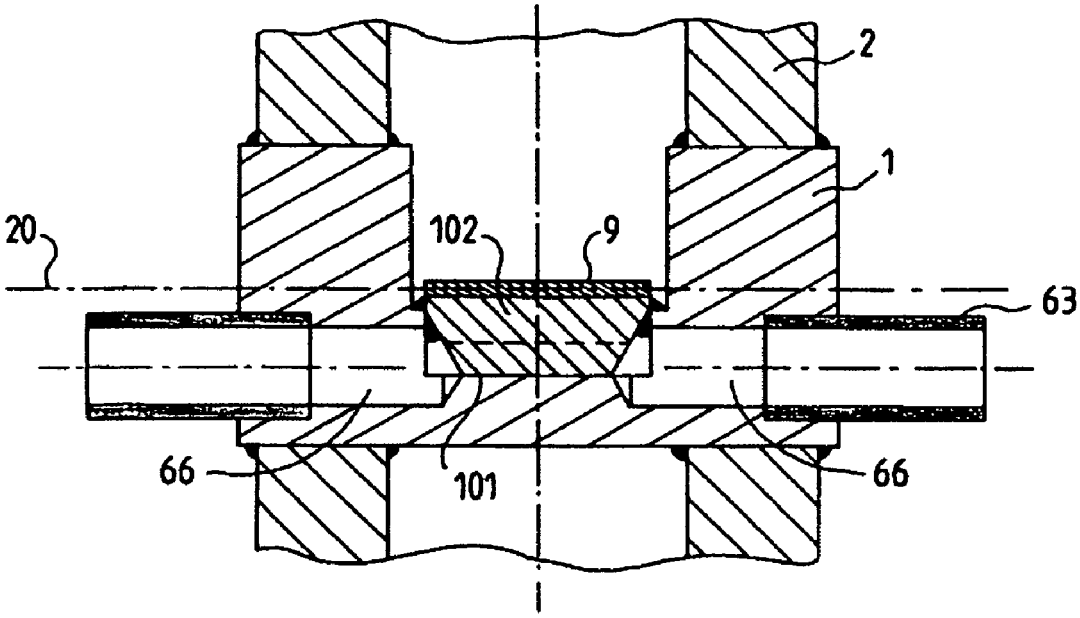
FIG. 16 depicts a front view in cross section and a side view in cross section of the target carrier assembly comprising cylindrical secondary ducts of triangular cross section.
Figure 16:
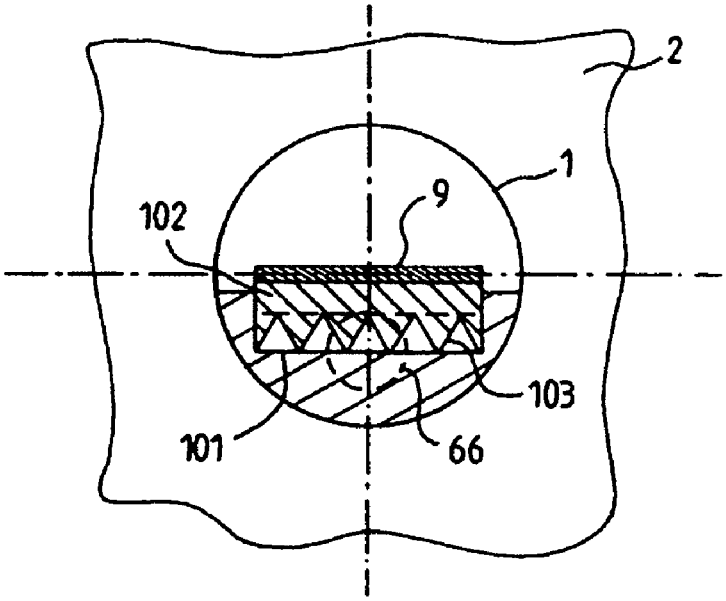

The final shape of the ducts depends on the initial shape of the grooves, thus allowing the desired heat exchange surface area to be customized. By way of example, FIGS. 14 and 15 show two shapes of groove 103. In FIG. 14, the grooves are V-shaped and the final cross section of the ducts is triangular. In FIG. 15, the grooves are arch-shaped and the final cross section of the ducts is the shape of an inverted D. FIG. 16 depicts a front view in cross section and a side view in cross section showing the arrangement of the target carrier assembly 1 comprising the mechanical assembly 102 in the anode unit 2. In this arrangement, the ends of the duct may also comprise adapter cuffs 63.

The invention claimed is:

1. An X-ray generator tube comprising:

an electron gun emitting an electron beam, an anode unit comprising a target carrier assembly having a flat surface as an x-ray target onto which the electron beam is focused in a focusing spot, the target carrier assembly having an axis of revolution substantially perpendicular to the mean direction of the electron beam and passing through the plane of the target, the target carrier assembly further comprising at least one internal cooling-fluid-circulation duct passing through the target carrier assembly in a direction substantially parallel to the axis of revolution of the target and passing under the target in order to cool the target, wherein the duct comprises a central part as an exchanger placed under the target and formed of a plurality secondary ducts of cylindrical shape and with generating lines parallel to the axis of revolution of the target carrier assembly.

2. The tube as claimed in claim 1, wherein the target carrier assembly is of cylindrical shape overall with a circular cross section, the target being situated in a plane passing through the axis of revolution of the cylinder and the anode unit comprising a housing, also of cylindrical shape overall and in which said target carrier assembly is housed such that the axis of revolution of the target carrier assembly passes through the focusing spot.

3. The tube as claimed in claim 1, wherein the cross section of the secondary ducts is circular.

4. The tube as claimed in claim 3, wherein the secondary ducts have a diameter of a size greater than the thickness of the wall separating them.

5. The tube as claimed In claim 1, wherein the cross section of the secondary ducts is triangular or arch-shaped.

6. The method for producing an anode unit assembly comprising a target carrier assembly as claimed in claim 1, wherein the step of producing the target carrier assembly comprises the following substeps:

producing a first mechanical assembly of cylindrical shape overall comprising a main duct passing through said first assembly in a direction substantially parallel to its axis of revolution and in its central part a recess comprising a flat surface, the main duct opening into this recess;

producing a second mechanical assembly comprising a flat top surface and a bottom surface comprising identical grooves;

assembling the second assembly in the recess of the first assembly in such a way that the grooves are placed facing the flat surface of the recess, the top surface of the second assembly constituting the target, the collection of grooves of the second assembly and of the flat surface of the recess constituting a plurality secondary ducts that form the exchanger.

* * * * *